US005242320A

United States Patent [19]

Schmidt et al.

[11] Patent Number: 5,242,320

[45] Date of Patent: Sep. 7, 1993

[54] SINGLE LEVER SHIFT/THROTTLE CONTROL SYSTEM

[75] Inventors: Edward A. Schmidt, Mandeville, La.; James W. Stuart, Poplarville, Miss.; Gregory J. Caston, Ponchatoula, La.

[73] Assignee: Marine Power, Inc., Ponchatoula, La.

[21] Appl. No.: 893,762

[22] Filed: Jun. 5, 1992

[51] Int. Cl.[5] ..... B60K 41/00

[52] U.S. Cl. ..... 440/86; 440/87

[58] Field of Search ..... 440/84, 86, 87; 180/333; 74/DIG. 8, 875, 480 B, 843

[56] References Cited

U.S. PATENT DOCUMENTS 2,433,235 12/1947 Panish ..... 74/875

*Primary Examiner*—Sherman Basinger

*Attorney, Agent, or Firm*—Joseph T. Regard

[57] ABSTRACT

A combination throttle/shift control system, configured for providing the full control of throttle and shift functions on a single lever, taught in the exemplary embodiment in conjunction with a marine propulsion system. The preferred embodiment of the present invention allows the full control of propulsion systems throttle and control functions in a single lever, as opposed to most traditional designs, which require the utilization of separate control levers and cables. This is accomplished via the utilization of a relay triggered actuator arrangement wherein there is provided a magnetic switch system for monitoring the positioning of the actuator travel rod relative a switched relay system. The present invention simplifies both the use and mechanical complexity of throttle and shift control systems, resulting in an appreciable increase in the ease of use, while reducing overall expense and maintenance requirements. While the present invention as implemented is taught in an exemplary capacity in conjunction with marine propulsion systems, the single lever shift/throttle control system may be utilized in conjunction with a variety of configuration engine packages, and is adaptable for use in transportation systems as well as machinery criteria. The present invention, as contemplated, may be implemented as a replacement kit for existing throttle and shifting cable arrangements, or may be provided as a modification package wherein nominal existing components are replaced.

4 Claims, 1 Drawing Sheet

SINGLE LEVER SHIFT/THROTTLE CONTROL SYSTEM

BACKGROUND OF INVENTION

1. Field of Invention

The present invention relates to control cable systems, and more particularly to a combination throttle/-shift control system, configured for providing the full control of throttle and shift functions utilizing a single lever, particularly in conjunction with a marine propulsion system.

The preferred embodiment of the present invention allows the full control of propulsion system's throttle and control functions in a single lever, as opposed to most traditional designs which require the utilization of separate control levers and cables for throttle and shift functions.

The present invention is able to provide a single lever system via the utilization of a relay triggered actuator arrangement wherein there is provided a magnetic switch system for monitoring the positioning of the actuator travel rod relative to a switched relay system.

While the present invention as implemented is taught in an exemplary capacity in conjunction with marine propulsion systems, the single lever shift/throttle control system may be utilized in conjunction with a variety of configured engine packages, and is adaptable for use in transportation systems as well as machinery criteria.

The present invention, as contemplated, may be implemented as a replacement kit for existing throttle and shifting cable arrangements, or may be provided as a modification package wherein nominal existing components are replaced.

2. Prior Art & General Background

While the prior art has contemplated a plethora of cable control configurations for a variety of applications, none are known to have specifically contemplated a single lever throttle/shift control system as taught in the present invention.

An electronic key work search was conducted on U.S. patents issued from 1971 to present on the DIALOG ® CLAIMS ® computer database. A list of prior patents which may be of interest is presented below:

| U.S. Pat. No. | Patentee(s) | Issue Date |
|---|---|---|
| 5,038,887 | Sousek E. A. | 08/03/91 |
| 5,035,580 | Simonnete D. W. | 07/30/91 |
| 5,022,368 | Kenny et al | 06/11/91 |
| 4,984,648 | Strzok M | 01/15/91 |
| 4,949,591 | Roelle D. R. | 08/21/90 |
| 4,940,109 | Haefner D. R. | 07/10/90 |
| 4,916,967 | Nakamuraa Y | 04/17/90 |
| 4,907,553 | Porter D. L. | 03/13/90 |
| 4,865,151 | Takeo et al | 09/12/89 |
| 4,841,445 | Yasunobu et al | 06/20/89 |
| 4,838,820 | Baumhardt R. J. | 06/13/89 |
| 4,363,283 | Ricardo G. L. | 12/21/82 |
| 4,322,208 | Kelpin T. G. | 03/30/82 |
| 4,414,956 | Baba M. | 03/20/79 |
| 4,089,397 | Baba M. | 05/16/78 |
| 4,013,155 | Olsen R. F. | 03/22/77 |

U.S. Pat. No. 4,144,956, entitled "Single Lever Control Unit for Engines", teaches a mechanical linkage system wherein the "control unit operates the clutch and throttle mainly of a marine engine by the single level, ensuring efficient warm-up operation and control of the engine."

U.S. Pat. No. 4,013,155, entitled "Single Lever Control Unit with Throttle Lever", issued 03/22/1977, contemplates "a single lever control for controlling engine, said control having a housing, a throttle actuating arm and a clutch actuating arm operatively connected thereto for rotation only during the first portion of rotation of the throttle actuating arm . . . ".

Although the above disclosed patents teach generally mechanical linkages of the clutch and throttle to control an engine, all are distinguishable from the present invention which teaches in its exemplary embodiment a relatively uncomplicated, electro-mechanical system for providing throttling and gear shifting in a single lever system.

The prior art, on the other hand, apparently has only contemplated rather bulky, complex mechanical systems for providing throttle and shift control systems for engines and the like, typically requiring great upkeep and maintenance.

3. General, Summary Discussion of the Invention

The present invention overcomes the complexities of past designs as disclosed in the prior art by providing a system which contemplates the utilization of a single throttle cable for controlling throttling, as well as shift functions, in an engine, and further providing an efficient, relatively economical and dependable engine control system which is designed for easy installation, as well as nominal upkeep requirements.

The preferred embodiment of the present invention contemplates a relay actuator arrangement, configured to be triggered via a switched throttle control lever, the actuator arrangement further providing a magnetic switch relay system affixed to the housing of the actuator travel rod for monitoring the positioning of the actuator travel rod.

The present invention contemplates a ground-based actuation system, wherein there is required nominal components, thereby greatly increasing the reliability of single lever throttle/shift systems, which in the past had been primarily of rather complex, mechanical design.

Although the present invention is comtemplated for use in conjunction with marine propulsion systems, it is easily adaptable for use in a variety of applications and may be offered in kit form for use with a variety of configurations of off-the-shelf systems, or specifically designed for use with a particular component system.

The present invention simplifies both the use and mechanical complexity of throttle and shift control systems, resulting in an appreciable increase in the ease of use, while reducing overall expense and maintenance requirements.

It is thus an object of the present invention to provide a single shift/throttle control system for use in conjunction with propulsion systems and the like, wherein there is needed only a single lever for actuating the shifting and throttle control mechanism.

It is another object of the present invention to provide a throttle control system which operatively engages the shifting system utilizing relay triggered actuator system.

It is another object of the present invention to provide a single lever control system for controlling the throttle and shifting functions of an engine wherein there is provided a travel rod having a magnet incorporated therein for communicating with spaced reed switches for controlling actuator functions.

It is still another object of the present invention to provide a single shift/lever control system wherein there is provided a switched throttle lever, having reverse, neutral, and forward designated switch areas, a first relay system for operatively monitoring the location of an shift actuator, and a second relay system in communication with the first relay system for engaging the actuator.

Lastly, it is an object of the present invention to provide a kit for adopting a variety of off-the-shelf marine propulsion systems and provide a single shift/throttle lever control system.

BRIEF DESCRIPTION of the DRAWINGS

For a further understanding of the nature and objects of the present invention, reference should be had to the following detailed description, taken in conjunction with the accompanying drawings, in which like parts are given like reference numerals, and wherein.

Figure 1:
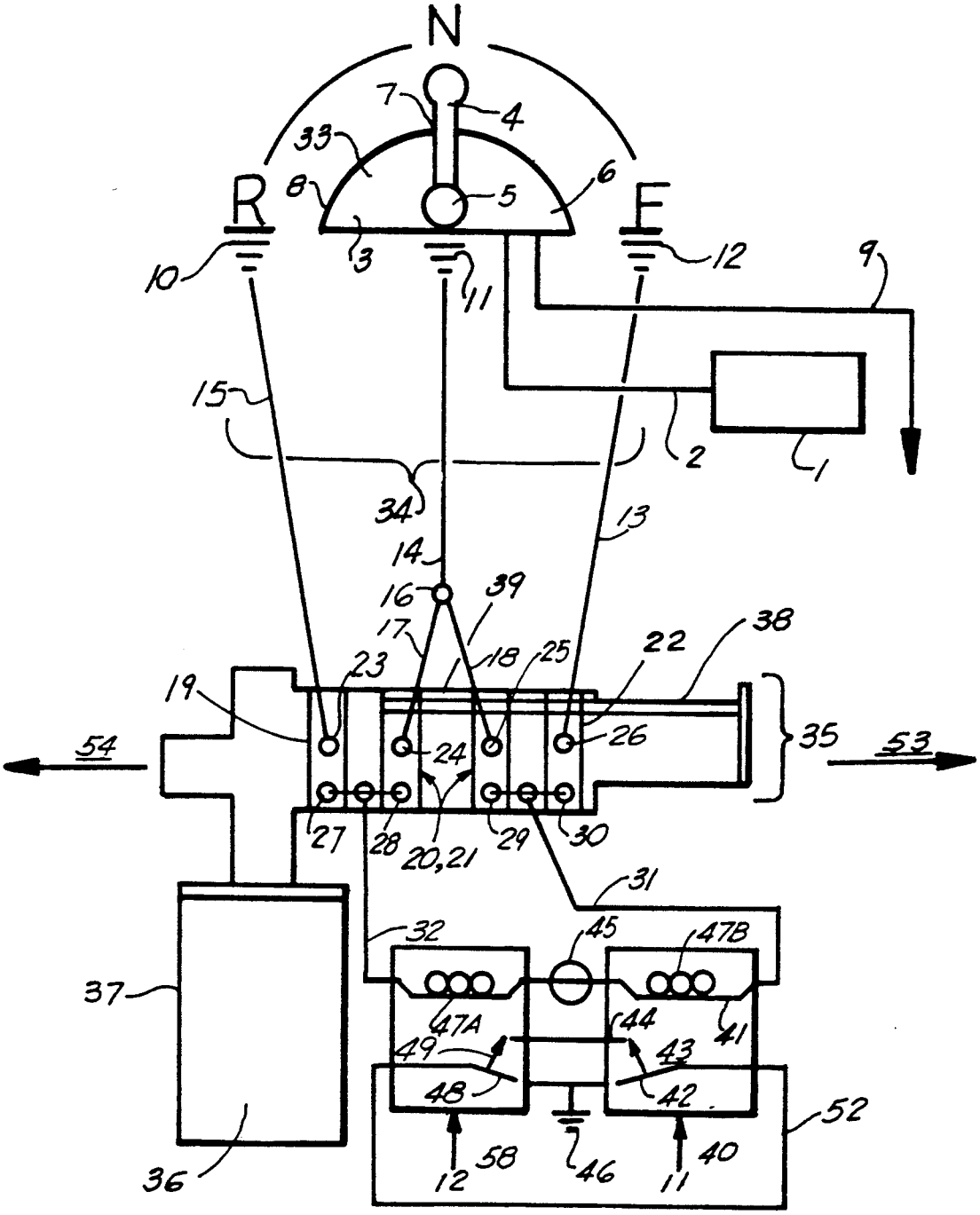
FIG. 1 is a schematic drawing illustrating the preferred embodiment of the single lever throttle/shift control system of the present invention in use with an exemplary embodiment of a marine propulsion system.

DETAILED DESCRIPTION of the PREFERRED, EXEMPLARY EMBODIMENTS

As can be seen in FIG. 1, the single shift/throttle lever control system of the preferred, exemplary embodiment of the present invention includes a throttle controller 33 having a lever housing 3 with a lever 4 pivotally affixed thereto via lever pivot shaft 6, the lever 4 communicating with a conventional throttle cable 2, providing forward 6, neutral 7 and reverse 8 positions to throttle 1.

Also in communication with lever 4 is lever slide switch 34, having reverse 10, neutral 11, and forward 12 positions, the slide switch 34 selectively providing negative polarity via ground 9 to reed switch bank 35, when said lever 4 is in the reverse 8, neutral 7, or forward 6 positions, via slide switch 34 having positions 10, 11, 12 and ground wires 15, 14, 13, respectively. An alternative embodiment of the present invention could utilize a system having a polarity opposite that of the present, preferred embodiment of the present invention, wherein the positive and negative polarities are reversed relative those illustrated in FIG. 1; in such an instance, the slide switch (34) would selectively provide a positive polarity via the battery or alternator, to read switch bank (35), and so on, as contemplated in the specification.

As shown, reed switch bank 35 comprises reverse 19, neutral 20, 21, and forward 22 magnetically actuated reed switches, each having inputs 23, 24, 25, 26 and outputs 27, 28, 29, 30, respectively, the reed switches 19, 20, 21, and 22 configured to magnetically communicate with actuator 37 travel bar 38 via magnet 39. Magnet 6 selectively opens reed bank 35 switches 19, 20, 21, 22, upon communication with same.

Reverse reed switch 19 comprises input 23, which communicates with ground wire 15, and output 27, configured to communicate with output line 32. Neutral reed switches 20, 21 include inputs 24, 25 and are configured to communicate with neutral ground wire 14 via leads 17, 18 and split 16.

Further, neutral reed switches 20, 21 have outputs 28, 29, each communicating with output lines 32 and 31, respectively. Lastly, forward reed switch 22 has input 26 configured to communicate with forward ground wire 13, and output 30, configured to communicate with output line 31.

Output lines 32, 31 are configured to communicate with coils 47, 41 in relays 50, 40, respectively. Coils 47, 41 have a positive input 45, such that negative polarity from outputs 32, 31 initiates coils 47, 41, drawing 49, 43 contact relay switches 48, 42 from ground 46 to positive contact 44, thereby selectively providing positive current from black 51 or orange 52 power lines to actuator 37 via motor 36, and providing linear forward 53 or reverse 54 motion via travel rod 38, which has magnet 39 thereon, for switching the shifter.

Thus, for example, should the user selectively engage the throttle lever 4 in the forward position 6 from the neutral 7 position, the lever slide switch 34 thus is switched forward 12, providing negative polarity via ground 9 to line 13 and closed forward reed switch 22 and output line 31 via switch output 30, energizing coil 41 and providing positive current via orange lead 52 to motor.

Relay 50 remains in open circuit, providing ground or negative polarity to black lead 51, thereby initiating motor 37, and powering travel bar 38 of actuator 36 forward 53 to switch the shifter in forward position. Magnet 39 is positioned on travel bar 38 such that it communicates with forward reed switch 22 at about the same time the shifter is initiated in forward position. Upon magnets 39 communication with reed switch 22, reed switch 22 opens circuits at relay 40, and thereby provides ground at both orange 52 and black 51 motor leads, stopping motor 37.

For one selectively engaging the throttle lever 4 from the forward position 6 to the neutral 7 position, the lever slide switch 34 thus is switched neutral 11, providing negative polarity via ground 9 to line 14, dividing at split 16 to neutral reed switches 20, 21 inputs 24, 25 via lines 17, 18. However, because reed switch 21 is open via magnet's 39 current position, the negative polarity only flows from reed switch 20, energizing coil 47A and providing positive current at relay 50 via line 32, to black lead 51 and motor 37.

Relay 40 remains in open circuit from the last cycle, providing ground or negative polarity to orange lead 52, thereby initiating motor 37, and powering travel bar 38 of actuator 36 reverse 54 to switch the shifter in reverse position. Magnet 39 is positioned on travel bar 38 such that it communicates with neutral reed switch 20 (as it is already in communication with neutral reed switch 21), at about the same time the shifter is initiated in neutral position.

Upon magnets 39 communication with reed switch 20, reed switch 20 is opened, ceasing polarity to relay 50, and ceasing positive current via black lead 51 to motor 37, terminating power to motor.

For one selectively engaging the throttle lever 4 from the neutral position 7 to the reverse 8 position, the lever slide switch 34 thus is switched reverse 10, providing negative polarity via ground 9 at line 15 to closed neutral reed switch 19 input 23. Negative polarity thereby flows from reed switch 19, energizing coil 47 and providing positive current at relay 50 via line 32 to black lead 51 and motor 37.

Relay 40 remains in open circuit from the last cycle, providing ground or negative polarity to orange lead 52, thereby initiating motor 37, and powering travel bar 38 of actuator 36 reverse 54 to switch the shifter in reverse position.

Magnet 39 is positioned on travel bar 38 such that it communicates with reverse reed switch 19, at about the same time the shifter is initiated in reverse position. Upon magnets 39 communication with reed switch 19, reed switch 19 is opened, ceasing polarity to relay 50, and ceasing positive current via black lead 51 to motor 37.

For one selectively engaging the throttle lever 4 from the reverse position 8 to the neutral 7 position, the lever slide switch 34 thus is switched neutral 11, providing negative polarity via ground 9 to line 14, dividing at split 16 to neutral reed switches 20, 21 inputs 24, 25 via lines 17, 18.

However, because reed switch 20 is open via magnet's 39 current position, the negative polarity only flows from reed switch 21, energizing coil 47B and providing positive current at relay 40 via line 31 to orange lead 52 and motor 36.

Relay 50 remains in open circuit from the last cycle, providing ground or negative polarity to black lead 51, thereby initiating motor 37, and powering travel bar 38 of actuator 36 forward 53 to switch the shifter in neutral position. Magnet 39 is positioned on travel bar 38 such that it communicates with neutral reed switch 21 (as it is already in communication with neutral reed switch 20), at about the same time the shifter is initiated in neutral position.

Upon magnet's 39 communication with reed switch 21, reed switch 21 is opened, ceasing polarity to relay 40, and ceasing positive current via orange lead 52 to motor 37; motor ceases.

For one selectively engaging the throttle lever 4 from the forward position 6 to the reverse 8 position, the lever slide switch 34 thus is switched to reverse 10, providing negative polarity via ground 9 to line 15 and reed switch 19 input 23, providing negative polarity from reed switch output 27, energizing coil 47A and providing positive current to relay 50 via line 32 to black lead 51 and motor 37.

Relay 40 remains in open circuit from the last cycle, providing ground or negative polarity to orange lead 52, thereby initiating motor 37, and powering travel bar 38 of actuator 36 reverse 54 to switch the Shifter in reverse position. Magnet 39 is positioned on travel bar 38 such that it communicates with reverse reed switch 19, at about the same time the shifter is initiated in reverse position.

Upon magnets 39 communication with reed switch 19, reed switch 19 is opened, ceasing polarity to relay 50, and ceasing positive current via black lead 51 to motor 37, ceasing power to motor.

Should the user selectively engage the throttle lever 4 in the forward position 6 from the reverse 8 position, the lever slide switch 34 thus is switched forward 12, providing negative polarity via ground 9 to line 13 and closed forward reed switch 22 and output line 31 via switch output 30, energizing coil 47B and providing positive current to via orange lead 52 to motor.

Relay 50 remains in open circuit, providing ground or negative polarity to black lead 51, thereby initiating motor 37, and powering travel bar 38 of actuator 36 forward 53 to switch the shifter in forward position.

Magnet 39 is positioned on travel bar 38 such that it communicates with forward reed switch 22 at about the same time the shifter is initiated in forward position. Upon magnet's 39 communication with reed switch 22, reed switch 22 opens circuits at relay 40, and thereby providing ground at both orange 52 and black 51 motor leads, stopping motor 37.

An alternative embodiment of the present invention teaches a single lever control system wherein there is utilized a fluid powered, for example hydraulic or pneumatic, pressured system configured to form a dual action ram. One could even conceivably utilize the fluid pressure generated by a water jet propulsion system.

In this alternative embodiment, the cabling and relay systems would remain intact, with the change being with regard to the actuation means. As opposed to an electrically motor driven actuator, there would be utilized the fluid powered means as set forth above for providing a reciprocating, linear actuator which would be fluid powered, such as a hydraulic reciprocating piston cylinder.

The cylinder would communicate with the transmission, directing the gear shift lever to the appropriate position, via electrically driven solenoid valves which would be in communication with the relay system, wherein the appropriate valves would be actuated in order to drive the cylinder to the appropriate position.

| Exemplary Specifications | |
|---|---|
| Lever control console | Morse Mn |
| Slide Switch | Morse B48255 |
| Solenoid | Xolox TBD |
| Magnet configuration | Rectangular, high gauss |
| Electronic linear actuator | Motion System 85151 |
| Reed Switch | SKF 901590 |
| Relay | Hella 4RD-960-388-25 |
| Solenoid Motor | ## Horsepower, reversible D.C. |

The embodiments described herein in detail for exemplary purposes are of course subject to many different variations in structure, design, application and methodology. Because many varying and different embodiments may be made within the scope of the inventive concepts herein taught, and because many modifications may be made in the embodiments herein detailed in accordance with the descriptive requirements of the law, it is to be understood that the details herein are to be interpreted as illustrative and not in a limiting sense.

What is claimed is:

1. A single lever throttle/shift control system, for providing throttle control and shifting control to a propulsion system having a throttle and shifter, respectively, said control system operable with a single controller lever, said control system comprising:

a throttle controller (33) having a lever housing (3) with a lever (4) in communication therewith, said lever (4) having reverse (8), neutral (7), and forward (6) positions;

a throttle cable (2) having first and second ends, said first end of said throttle cable (2) in communication with said lever (4), said second end of said throttle cable (2) in communication with the throttle of the propulsion system;

a lever slide switch (34) in communication with said lever (4), said lever slide switch (34) having reverse (10), neutral (11), and forward (12) switching positions, providing first (15), second (14) and third (13) outputs, respectively, said switching positions corresponding with said reverse (8), neutral (7) and forward (6) positions of said lever (4), said lever slide switch (34) configured to selectively provide negative polarity via either any one of said first (15), second (14), or third (13) outputs, depending upon the position of said lever (4);

a locally deactuable switch bank (35) comprising reverse, first and second neutral, and forward reed switches, forming first (31) and second (32) output lines, respectively, said switch bank configured for receiving said first, second, or third outputs of said lever slide switch (34), respectively, and outputting same to said first (31) and second (32) output lines, until de-actuated;

relay means configured to separably receive input from said first (32) and second (31) output lines, respectively, said relay means providing first (51) and second (52) solenoid output lines of opposing polarities, the polarity of each line dependent upon the input received by said relay means; said relay means consisting of first (50) and second (40) relays having coils (47), (41) and contact relay switches (48), (42), said contact relay switches (48), (42) each having a switchable ground or positive contact respectively, said coils (47), (41) having a common positive input (45), such that negative polarity from said second (32) or first (31) output lines initiates one of said coils (47), (41), drawing one of said contact relay switches (48), (42) from ground to positive contact, thereby selectively providing positive current to one of said first (51) and second (52) solenoid output lines;

solenoid means for controlling the shifter of the propulsion system, said solenoid means receiving input from said first (51) and second (52) solenoid output lines, said solenoid means including a motor which is reversible based upon the polarity of said first (51) and second (52) solenoid output lines, said motor controlling a travel rod (38) configured to communicate with the shifter; and de-actuation means for opening the circuits of said switch bank (35), said de-actuation means associated with said travel rod (38), and arranged to communicate with said switch bank generally about when the travel rod has urged the shifter in the desired position.

2. The method of providing throttle control and shifting control to a propulsion system having a throttle and shifter, respectively, said control system operable with a single controller lever, the method comprising the steps of:

(a) providing a single lever throttle/shift control system, comprising:

a throttle controller (33) having a lever housing (3) with a lever (4) in communication therewith, said lever (4) having reverse (8), neutral (7), and forward (6) positions;

a throttle cable (2) having first and second ends, said first end of said throttle cable (2) in communication with said lever (4), said second end of said throttle cable (2) in communication with the throttle of the propulsion system;

a lever slide switch (34) in communication with said lever (4), said lever slide switch (34) having reverse (10), neutral (11), and forward (12) switching positions, providing first (15), second (14) and third (13) outputs, respectively, said switching positions corresponding with said reverse (8), neutral (7) and forward (6) positions of said lever (4), said lever slide switch (34) configured to selectively provide negative polarity via either any one of said first (15), second (14), or third (13) outputs, depending upon the position of said lever (4);

a locally deactuable switch bank (35) comprising reverse, first and second neutral, and forward reed switches, forming first (31) and second (32) output lines, respectively, said switch bank configured for receiving said first, second, or third outputs of said lever slide switch (34), respectively, and outputting same to said first (31) and second (32) output lines, until de-actuated;

relay means configured to separably receive input from said first (32) and second (31) output lines, respectively, said relay means providing first (51) and second (52) solenoid output lines of opposing polarities, the polarity of each line dependent upon the input received by said relay means; said relay means consisting of first (50) and second (40) relays having coils (47), (41) and contact relay switches (48), (42), said contact relay switches (48), (42) each having a switchable ground or positive contact respectively, said coils (47), (41) having a common positive input (45), such that negative polarity from said second (32) or first (31) output lines initates one of said coils (47), (41), drawing one of said contact relay switches (48), (42) from ground to positive contact, thereby selectively providing positive current to one of said first (51) and second (52) solenoid output lines;

solenoid means for controlling the shifter of the propulsion system said solenoid means receiving input from said first (51) and second (52) solenoid output lines, said solenoid means including a motor which is reversible based upon the polarity of said first (51) and second (52) solenoid output lines, said motor controlling a travel rod (38) configured to communicate with the shifter; and de-actuation means for opening the circuits of said switch bank (35), said de-actuation means associated with said travel rod (38), and arranged to communicate with said switch bank generally about when the travel rod has urged the shifter in the desired position;

(b) positioning said de-actuation means on said travel rod (38) such that it will communicate with said forward reed switch at about the same time that said shifter shifts to the forward position;

(c) initiating said throttle controller from neutral to forward position;

(d) providing negative polarity to said relay means;

(e) providing positive current to said second (52) solenoid output line, and to said motor;

(f) initiating said motor, driving said solenoid, and powering said travel bar (52) in such a manner as to switch the shifter in forward position; and (g) stopping said motor.

3. A single lever throttle/shift control system, for providing throttle control and shifting control to a propulsion system having a throttle and shifter, respectively, said control system operable with a single controller lever, said control system comprising:

a throttle controller (33) having a lever (4) in pivotal communication therewith, said lever (4) having reverse (8), neutral (7), and forward (6) positions;

a throttle cable (2) having first and second ends, said first end of said throttle cable (2) in communication with said lever (4), said second end of said throttle cable (2) in communication with the throttle of the propulsion system;

a lever slide switch (34) in communication with said lever (4), said lever slide swich (34) having reverse (10), neutral (11), and forward (12) switching position, providing first (15), second (14) and third (13) outputs, respectively, said switching positions corresponding with said reverse (8), neutral (7) and forward (6) positions of said lever (4) said lever slide switch (34) configured to selectively provide negative polarity via either any one of said first (15), second (14), or third (13) outputs, depending upon the position of said lever (4);

a locally deactuable switch bank (35) comprising reverse, first and second neutral, and forward reed switches, forming first (31) and second (32) output lines, respectively, said switch bank configured for receiving said first, second, or third outputs of said lever slide switch (34), respectively, and outputting same to said first (31) and second (32) output lines, until de-actuated;

relay means configured to separably receive input from said first (32) and second (31) output lines, respectively, said relay means providing first (51) and second (52) solenoid output lines of opposing polarities, the polarity of each line dependent upon the input received by said relay means; said relay means consisting of first (50) and second (40) relays having coils (47), (41) and contact relay switches (48), (42), said contact relay switches (48), (42) each having a switchable ground or positive contact respectively, said coils (47), (41) having a common positive input (45), such that negative polarity from said second (32) or first (31) output lines initiates one of said coils (47), (41), drawing one of said contact relay switches (48), (42) from ground to positive contact, thereby selectively providing positive current to one of said first (51) and second (52) solenoid output lines;

solenoid means for controlling the shifter of the propulsion system, said solenoid means receiving input from said first (51) and second (52) solenoid output lines, said solenoid means including a motor which is reversible based upon the polarity of said first (51) and second (52) solenoid output lines, said motor controlling a travel rod (38) configured to communicate with the shifter; and de-actuation means for opening the circuits of said switch bank (35), said de-actuation means associated with said travel rod (38), and arranged to communicate with said switch bank generally about when the travel rod has urged the shifter in the desired position.

4. The method of providing throttle control and shifting control to a propulsion system having a throttle and shifter, respectively, said control system operable with a single controller lever, the method comprising the steps of:

(a) providing a single lever throttle/shift control system, comprising:

a throttle controller (33) having a lever housing (3) with a lever (4) in pivotal communication therewith, said lever (4) having reverse (8), neutral (7), and forward (6) positions;

a throttle cable (2) having first and second ends, said first end of said throttle cable (2) in communication with said lever (4), said second end of said throttle cable (2) in communication with the throttle of the propulsion system;

a lever slide switch (34) in communication with said lever (4), said lever slide switch (34) having reverse (10), neutral (11), and forward (12) switching positions, providing first (15), second (14) and third (13) outputs, respectively, said switching positions corresponding with said reverse (8), neutral (7) and forward (6) positions of said lever (4), said lever slide switch (34) configured to selectively provide negative polarity via either any one of said first (15), second (14), or third (13) outputs, depending upon the position of said lever (4);

a locally deactuable switch bank (35) comprising reverse, first and second neutral, and forward reed switches, forming first (31) and second (32) output lines, respectively, said switch bank configured for receiving said first, second, or third outputs of said lever slide switch (34), respectively, and outputting same to said first (31) and second (32) output lines, until de-actuated;

relay means configured to separably receive input from said first (32) and second (31) output lines, respectively, said relay means providing first (51) and second (52) solenoid output lines of opposing polarities, the polarity of each line dependent upon the input received by said relay means; said relay means consisting of first (50) and second (40) relays having coils (47), (41) and contact relay switches (48), (42), said contact relay switches (48), (42) each having a switchable ground or positive contact respectively, said coils (47), (41) having a common positive input (45), such that negative polarity from said second (32) or first (31) output lines initiates one of said coils (47), (41), drawing one of said contact relay switches (48), (42) from ground to positive contact, thereby selectively providing positive current to one of said first (51) and second (52) solenoid output lines;

solenoid means for controlling the shifter of the propulsion system, said solenoid means receiving input from said first (51) and second (52) solenoid output lines, said solenoid means including a motor which is reversible based upon the polarity of said first (51) and second (52) solenoid output lines, said motor controlling a travel rod (38) configured to communicate with the shifter; and de-actuation means for opening the circuits of said switch bank (35), said de-actuation means associated with said travel rod (38), and arranged to communicate with said switch bank generally about when the travel rod has urged the shifter in the desired position.

(b) positioning said de-actuation means on said travel rod (38) such that it will communicate with said reverse reed switch at about the same time that said shifter shifts to the reverse position;

(c) initiating said throttle controller from neutral to reverse position;

(d) providing negative polarity to said relay means;

(e) providing positive current to said first (51) solenoid output line, and to said motor;

(f) initiating said motor, driving said solenoid, and powering said travel bar (52) in such a manner as to switch the shifter in reverse position; and (g) stopping said motor.

* * * * *